US007524357B2

(12) United States Patent
Daukant

(10) Patent No.: US 7,524,357 B2
(45) Date of Patent: Apr. 28, 2009

(54) SELF-CONTAINED ELECTROSTATIC AIR/OIL SEPARATOR FOR AIRCRAFT ENGINE

(75) Inventor: Robert Allan Daukant, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 412 days.

(21) Appl. No.: 11/536,011

(22) Filed: Sep. 28, 2006

(65) Prior Publication Data

US 2008/0078291 A1 Apr. 3, 2008

(51) Int. Cl.
*B03C 3/011* (2006.01)

(52) U.S. Cl. ..... 95/69; 55/306; 55/431; 95/78; 96/57; 96/61; 96/63

(58) Field of Classification Search ..... 95/63, 95/69, 78; 96/55, 57, 60–64; 55/306, 431, 55/471, 473

See application file for complete search history.

(56) References Cited

U.S. PATENT DOCUMENTS

| | | | | | |
|---|---|---|---|---|---|
| 342,548 | A | | 5/1886 | Walker | |
| 1,067,974 | A | | 7/1913 | Cottrell | |
| 1,982,470 | A | * | 11/1934 | Franks | 95/78 |
| 2,000,654 | A | | 5/1935 | Wintermute | |
| 2,119,297 | A | * | 5/1938 | Scott | 95/63 |
| 2,594,805 | A | * | 4/1952 | Rommel | 96/61 |
| 2,740,493 | A | * | 4/1956 | Wintermute | 95/64 |
| 3,070,977 | A | | 1/1963 | Kimmel et al. | |
| 3,271,932 | A | | 9/1966 | Newell | |
| 3,406,669 | A | | 10/1968 | Edwards | |
| 3,443,362 | A | * | 5/1969 | Ebert | 96/50 |
| 3,853,750 | A | * | 12/1974 | Volsy | 209/127.1 |
| 4,649,703 | A | * | 3/1987 | Dettling et al. | 60/275 |
| 4,689,951 | A | * | 9/1987 | Polach | 60/275 |
| 4,935,209 | A | * | 6/1990 | Pfoutz | 422/128 |
| 5,380,355 | A | * | 1/1995 | Brothers | 96/64 |
| 5,429,669 | A | | 7/1995 | Chang | |
| 5,690,720 | A | * | 11/1997 | Spero | 96/26 |
| 5,779,769 | A | * | 7/1998 | Jiang | 96/55 |
| 5,911,213 | A | | 6/1999 | Ahlborn et al. | |
| 6,185,934 | B1 | * | 2/2001 | Teboul | 60/297 |
| 6,221,136 | B1 | | 4/2001 | Liu et al. | |
| 6,224,653 | B1 | | 5/2001 | Shvedchikov et al. | |
| 6,530,979 | B2 | * | 3/2003 | Firey | 95/270 |
| 7,022,150 | B2 | * | 4/2006 | Borgstrom et al. | 55/338 |
| 2003/0029318 | A1 | * | 2/2003 | Firey | 95/267 |
| 2008/0060522 | A1 | * | 3/2008 | Bertuccioli et al. | 96/55 |
| 2008/0264251 | A1 | * | 10/2008 | Szepessy | 95/35 |

FOREIGN PATENT DOCUMENTS

| | | | | | |
|---|---|---|---|---|---|
| EP | 0 157 089 | | | 1/1985 | |
| JP | 55-87852 | A | * | 7/1980 | 96/61 |

* cited by examiner

*Primary Examiner*—Richard L Chiesa
(74) *Attorney, Agent, or Firm*—Ogilvy Renault LLP

(57) ABSTRACT

An air/oil separator for use in a gas turbine engine includes a centrifugal separation stage in fluid communication with a downstream electrostatic separation stage. The centrifugal separation stage rotationally drives an electric generator to power the electrostatic separation stage.

16 Claims, 1 Drawing Sheet

SELF-CONTAINED ELECTROSTATIC AIR/OIL SEPARATOR FOR AIRCRAFT ENGINE

TECHNICAL FIELD

The invention relates generally to an apparatus for separating a liquid in suspension, and more particularly, to an improved air/oil separator for use in a gas turbine engine.

BACKGROUND OF THE ART

Gas turbine engine oil systems require a separator for separating air and oil from the air/oil mixture produced during engine operation. These mixtures vary from oil emulsified with air, to air contaminated by droplets of oil. For example, the compressed air streams used in gas turbine engines to pressurize labyrinth seals for the engine main bearings in order to avoid excessive loss of lubricating oil, invariably become contaminated with oil in the form of particles suspended in the air. Loss of contaminated air from the labyrinth seals in the compressor disadvantageously causes fouling of the engine parts and produces noxious and unpleasant contaminates in air drawn from the compressor for cabin pressurization. Engine oil tanks, auxiliary gearboxes, and the oil system in general contain a pressure above the ambient pressure and need to vent to the atmosphere. The increased loss of lubricating oil from the engine oil tank further disadvantageously necessitates larger capacity oil tanks, thereby adding to the overall weight of the engine, which is particularly a problem relating to aircraft engines. Centrifugal separators have been extensively used in the aircraft industry in attempts to remove the majority of oil mixture from compressed air streams. However, efforts have been continuously made in the aircraft industry to improve the efficiency of air/oil separators in gas turbine engine oil systems.

Additionally, industry trends are moving away from mechanically/gearbox driven, to electrically driven accessories, so the availability of an appropriate shaft/drive to operate a conventional centrifugal separator will be reduced or possibly eliminated in the future.

Accordingly, there is a need to provide an improved air/oil separator for use in gas turbine engines.

SUMMARY OF THE INVENTION

It is therefore an object of this invention to provide an air/oil separator for use in a gas turbine engine, particularly aircraft engines.

In one aspect, the present invention provides an air/oil separator for use in a gas turbine engine, which comprises a centrifugal separation stage in fluid communication with a downstream electrostatic separation stage, the centrifugal separation stage rotationally driving an electric generator to power the electrostatic separation stage.

In another aspect, the present invention provides an air/oil separator for use in a gas turbine engine, which comprises a turbine rotor disposed in a passage and adapted to be rotated by an air/oil mixture flow passing through the passage to separate oil from the air/oil mixture flow; means for further directing the air/oil mixture flow after passing though the turbine rotor; a labyrinth path defined by electrically conductive walls, the labyrinth path having an inlet for receiving the air/oil mixture flow directed by the means, and a first outlet for discharging substantially purified air, means for electrically, positively charging the air/oil mixture flow with respect to the conductive walls of the labyrinth path before the air/oil mixture flow enters the labyrinth path, to further separate oil from the air/oil mixture flow in the labyrinth path; and means for collecting the separated oil from the respective passage and labyrinth path.

In a further aspect, the present invention provides a method for separating oil from an air/oil mixture in a gas turbine engine which comprises steps of: 1) directing a flow of air/oil mixture into a centrifugal separation stage to centrifugally separate a first portion of oil from the air/oil mixture; 2) electrically and positively charging the flow of air/oil mixture exiting from the centrifugal separation stage; and 3) further directing the electrically, positively charged flow of air/oil mixture into an electrostatic separation stage defined by an electrically grounded labyrinth path to electrostatically separate a second portion of oil from the air/oil mixture.

Further details of these and other aspects of the present invention will be apparent from the detailed description and drawings included below.

DESCRIPTION OF THE DRAWINGS

Reference is now made to the accompanying drawing depicting aspects of the present invention, in which.

DETAILED DESCRIPTION OF THE PREFERRED EMBODIMENTS

Figure 1:
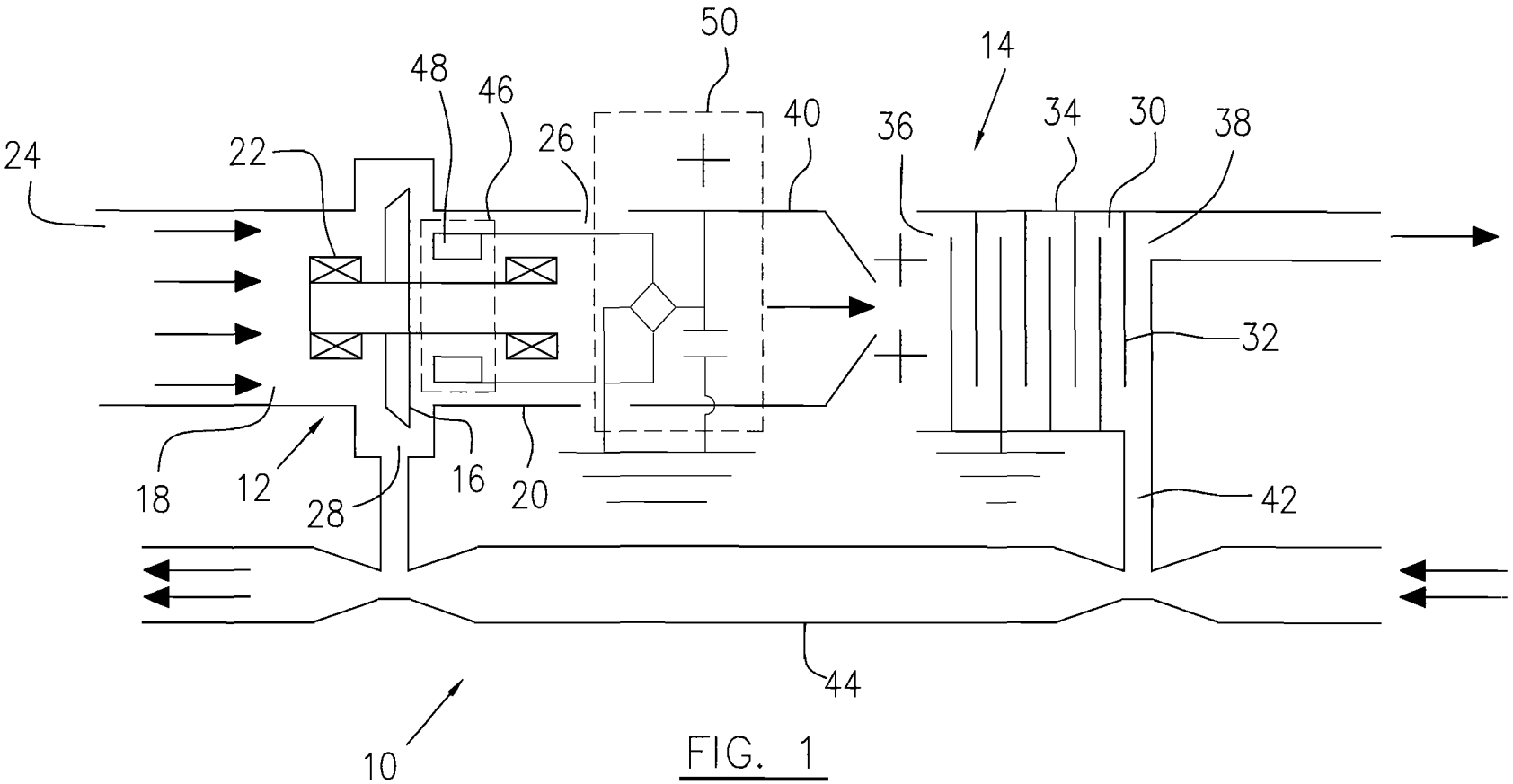
FIG. 1 is a schematic illustration of an air/oil separator for use in a gas turbine engine according to one embodiment of the present invention, showing a centrifugal separation stage in fluid communication with a downstream electrostatic separation stage.

Referring to FIG. 1, an air/oil separator generally indicated by numeral 10 includes a centrifugal separation stage 12 in fluid communication with a downstream electrostatic separation stage 14. The centrifugal separation stage 12 includes a turbine rotor 16 disposed in a passage 18, for example a casing 20. The turbine rotor, for example having a plurality of blades mounted on a rotor shaft (not indicated), is supported through a pair of bearings 22 on a stationary structure (not shown) within the casing 20 and is thereby adapted to be rotated by a fluid flow passing through the passage 18 from an inlet end 24 to an outlet end 26 of the passage 18. The casing 20 preferably includes a first oil drainage outlet 28 located in a lower portion of the passage 18.

The electrostatic separation stage 14 preferably includes a labyrinth path 30 which is preferably formed by a plurality of electrically conductive walls 32 mounted transversely within a casing 34 with respect to a fluid flow direction. The walls 32, partially partition the casing 34 with spaces or openings alternately located at the top and bottom ends of the walls 32, so as to define the continuous labyrinth path 30 through the casing 34 from an inlet end 36 to an outlet end 38 thereof.

The casing 34 is preferably electrically conductive. The electrically conductive walls 32 are electrically connected to the casing 34, for example, by welding.

A nozzle, preferably an electrically conductive nozzle 40, is provided between, and is also in fluid communication with, the casings 20 and 34, to receive a fluid flow passing through the passage 18 and to further inject the fluid flow into the labyrinth path 30. The electrically conductive nozzle 40 and the casing 34 with the electrically connected walls 32, are electrically charged with opposite polarities. For example the casing 34 and the walls 32 are electrically grounded and the nozzle 40 is electrically positively charged, thereby forming the electrostatic separation stage 14.

The casing 34 preferably further includes a second oil drainage outlet 42, located at a lower portion of the casing 34. A number of the walls 32 which are directly mounted at the lower ends thereof to the casing 34, preferably include a plurality of small holes (not shown) at the lower ends thereof. The utility of those small holes will be further discussed in the description of the operation of the air/oil separator 10.

Optionally, a jet pump 44 is connected to the respective first and second oil drainage outlets 28, 42. The jet pump 44 is also connected at the input end thereof (not indicated) to a source of pressurized air or oil (not shown) and at the output end thereof (not indicated) to an oil tank of the gas turbine engine.

The electrostatic separation stage 14 may be electrically connected to an external DC high voltage source. Nevertheless, it is preferable to include an electric generator in the air/oil separator 10 in order to provide the electric energy for the electrostatic separation stage 14, and also to provide mechanical loading to prevent overspeeding of the turbine.

As an example of the present invention, an electric generator 46 is provided and is driven by the turbine rotor 16. The electric generator 46 is preferably a permanent magnetic AC generator incorporated in the turbine rotor 16. For example, a section of the rotor shaft of the turbine rotor 16 includes at least a permanent magnet (not shown) properly mounted thereon such that this section of the rotor shaft of the turbine rotor 16 functions as a magnetic rotor of an AC generator. A plurality of windings 48 of electric coils are appropriately positioned around that section of the rotor shaft of the turbine rotor 16, and are supported by a stationary structure (not shown) within the casing 20. The windings 48 which function as a stator of the AC generator, produce AC voltages when the turbine rotor 16 rotates. The windings 48 are electrically connected to an electric voltage conditioner 50 for electric voltage rectification. The electric voltage conditioner 50, which is schematically illustrated within the block defined by broken lines, is well known in the art and will not be further described. The electric voltage conditioner 50 is appropriately electrically grounded and connected to the electrically conductive nozzle 40 to provide the necessary high DC voltage for the electrostatic separation stage 14.

In operation a flow of air/oil mixture, for example from an oil tank or an auxiliary gearbox of the gas turbine engine, is directed into the passage 18 through the inlet end thereof 24. The oil tank and the auxiliary gearbox contain a pressure inside which is above the ambient pressure, and thus the flow of air/oil mixture under such a pressure impinges on the blades of the turbine rotor 16 to drive same to rotate. Oil precipitation occurs as a result of the impingement of the flow of air/oil mixture on the blades of the turbine rotor 16, thereby separating a portion of the oil particles suspended in the flow of air/oil mixture. The rotation of the turbine rotor 16 causes rotation of the flow of air/oil within the casing downstream of the blades of the turbine rotor 16, and thus produces centrifugal forces upon the oil particles which are suspended in and heavier than the air. Under the effect of the centrifugal forces, a further portion of the suspended oil particles are separated from the flow of air/oil mixture and precipitate on the inner surface of the casing 20. The oil particles separated from the flow of air/oil mixture within the casing 20 are eventually accumulated on the lower inner surface of the casing 20 and form liquid oil to be drained through the first oil drainage outlet 28.

The bearings 22 which operatively support the turbine rotor 16 within the casing 20 are preferably exposed to the flow of air/oil mixture passing through the passage 18 and are thus lubricated by same.

When the turbine rotor 16 is driven to rotate by the flow of air/oil mixture passing through the passage 18, the permanent magnetic AC generator 46 generates the required AC voltage which is rectified to a DC voltage by means of the voltage conditioner 50 such that the electrically conductive nozzle 40 is electrically, positively charged with respect to the electrically grounded casing 34 and walls 32 therein.

After passing through the centrifugal separation stage 12, the flow of air/oil mixture from which oil has been partially extracted and discharged through the first oil drainage outlet 28, is directed into the electrically positively charged nozzle 40 for example by a pipeline, or within an integrated configuration in which the nozzle 40 forms the outlet end 26 of the passage 18 but is electrically insulated from the casing 20. The remaining amount of oil particles suspended in the flow of air/oil mixture is electrically positively charged when the flow of air/oil mixture passes through the nozzle 40 and is injected into the fluid passage which is defined by the electrically grounded labyrinth path configuration 30. The electrically positively charged oil particles suspended in the flow of air/oil mixture are attracted to the electrically grounded walls 32 and the inner surface of the grounded casing 34. The electrically positive charges on the oil particles are neutralized when the oil particles contact the conductive surface of the grounded walls 32 and casing 34, and the oil particles are accumulated to form oil droplets and to eventually form liquid oil accumulated on the bottom or a lower portion of the casing 34.

In addition to the electrostatic precipitation, oil precipitation also occurs due to the impingement of suspended oil particles on the walls 32. The efficiency of oil precipitation is also improved by the increased contact surface area for oil precipitation provided by the labyrinth path 30 for the flow to follow.

The liquid oil separated from the flow of air/oil mixture passing through the labyrinth path 30 is accumulated on the bottom or at a lower portion of the casing 34 and is drawn to the second oil drainage outlet 42. Those small holes defined on a number of the walls 32 and located at the lower ends thereof, allow the liquid oil on the bottom or a lower portion of the casing to flow therethrough towards the second oil drainage outlet 42. The small holes are sized in a small dimension such that the liquid oil which passes through those small holes will block the holes to prevent air flow from passing through those small holes, preventing an air bypass to the labyrinth path 30. The airflow discharged from the outlet end 38 of the casing 34 is relatively oil-free due to the oil precipitation in the centrifugal separation stage 12 and electrostatic separation stage 14.

When the jet pump 44 is connected to the oil drainage outlets 28, 42, a pressurized air or oil jet is introduced through the jet pump 44 to create a suction action within the respective oil drainage outlets 28, 42 in order to draw the liquid oil out and deliver same under pressure to, for example, the oil tank.

The air/oil separator of the present invention is completely automatic and self-powered when a jet pump is not included. However, a jet pump or pumps can be added to scavenge the oil quickly, and/or raises the pressure of the oil for return to the tank. The air/oil separator of the present invention is in operation only when the engine is running and the internal pressure of the oil tank or gearbox is above ambient pressure. The turbine rotor speed and the generator voltage of the air/oil separator of the present invention will vary with engine speed and with the pressure differential between the oil tank or gearbox and the atmosphere. Therefore, the turbine rotor rotation and speed of the air/oil separator of the present invention will regulate the back-pressure in the oil tank and/or gearbox.

Temperature drop may occur while the flow of air/oil mixture passes through the passages of the air/oil separator, particularly across the turbine rotor which may cause additional oil precipitation.

The air/oil separator of the present invention can be advantageously installed in-line in an engine breather tube.

The above description is meant to be exemplary only, and one skilled in the art will recognize that changes may be made to the embodiments described without departure from the scope of the invention disclosed. For example, the fluid passage in the electrostatic separation stage can be otherwise configured, instead of the labyrinth path described above. The electric generator and the voltage conditioner can also be configured differently from the described embodiment. The nozzle for charging and directing the flow of air/oil mixture can be replaced by other devices having similar functions. The jet pump is optional and can be omitted, or replaced by other pumping devices. Still other modifications which fall within the scope of the present invention will be apparent to those skilled in the art, in light of a review of this disclosure, and such modifications are intended to fall within the appended claims.

The invention claimed is:

1. An air/oil separator for use in a gas turbine engine comprising a centrifugal separation stage in fluid communication with a downstream electrostatic separation stage, the centrifugal separation stage rotationally driving an electric generator to power the electrostatic separation stage.

2. The air/oil separator as defined in claim 1 wherein the centrifugal separation stage comprises a turbine rotor rotated by an air/oil mixture flow to be processed in the centrifugal separation stage.

3. The air/oil separator as defined in claim 1 wherein the electrostatic separation stage comprises a labyrinth path.

4. The air/oil separator as defined in claim 3 wherein the electrostatic separation stage comprises a flow nozzle for injecting the air/oil mixture flow from the centrifugal stage into the labyrinth path.

5. The air/oil separator as defined in claim 4 wherein a DC voltage is applied over the flow nozzle and the labyrinth path, with a positive polarity on the flow nozzle.

6. An air/oil separator for use in a gas turbine engine comprising:

a turbine rotor, disposed in a passage and adapted to be rotated by an air/oil mixture flow passing through the passage, to separate oil from the air/oil mixture flow;

means for further directing the air/oil mixture flow after having passed through the turbine rotor;

a labyrinth path defined by electrically conductive walls, the labyrinth path having an inlet for receiving the air/oil mixture flow directed by the means, and a first outlet for discharging substantially purified air;

means for electrically, positively charging the air/oil mixture flow with respect to the conductive walls of the labyrinth path before the air/oil mixture flow enters the labyrinth path, to further separate oil from the air/oil mixture flow in the labyrinth path; and means for collecting the separated oil from the respective passage and labyrinth path.

7. The air/oil separator as defined in claim 6 wherein the means for further directing the air/oil mixture flow comprises an electrically conductive flow nozzle.

8. The air/oil separator as defined in claim 7 wherein the means for electrically, positively charging the air/oil mixture flow with respect to the conductive walls of the labyrinth path, comprises a source of DC voltage connected to the respective electrically conductive flow nozzle and the electrically conductive walls of the labyrinth path with positive polarity on the electrically conductive flow nozzle.

9. The air/oil separator as defined in claim 8 wherein the source of DC voltage comprises an AC generator driven by the turbine rotor and a voltage conditioner for converting an AC voltage obtained from the AC generator into a DC voltage.

10. The air/oil separator as defined in claim 9 wherein the AC generator comprises a permanent magnetic rotor integrated with a shaft of the turbine rotor and a stator of electric conductor windings.

11. The air/oil separator as defined in claim 6 wherein the means for collecting the separated oil comprises a first drainage outlet defined in a lower portion of the passage, receiving the turbine rotor and a second drainage outlet defined in a lower portion of the labyrinth path.

12. The air/oil separator as defined in claim 6 wherein the means for collecting the separated oil comprises a jet pump to collect the separated oil accumulated in the respective passage receiving the turbine rotor and in the labyrinth path and to then deliver the collected oil to an oil tank.

13. A method for separating oil from an air/oil mixture in a gas turbine engine comprising:

1) directing a flow of air/oil mixture into a centrifugal separation stage to centrifugally separate a first portion of oil from the air/oil mixture;

2) electrically and positively charging the low of air/oil mixture exiting from the centrifugal separation stage; and 3) further directing the electrically, positively charged flow of air/oil mixture into an electrostatic separation stage defined by an electrically grounded labyrinth path, to electrostatically separate a second portion of oil from the air/oil mixture.

14. The method as defined in claim 13 wherein the flow of air/oil mixture is directed under a pressure to impinge on a rotor of the centrifugal separation stage, thereby driving the centrifugal separation stage to rotate.

15. The method as defined in claim 13 comprising a step of operating an electric generator by means of the centrifugal separation stage in order to electrically and positively charge the low of air/oil mixture exiting from the centrifugal separation stage.

16. The method as defined in claim 13 comprising a step of collecting the first and second portions of separated oil using a jet pump.

* * * * *